United States Patent [19]

Nagaoka et al.

[11] 4,442,176

[45] Apr. 10, 1984

[54] HEAT-SENSITIVE RECORDING SHEET

[75] Inventors: Kazuya Nagaoka; Sigeru Yoshii, both of Yokohama, Japan

[73] Assignee: Kawasaki Kasei Chemicals Ltd., Tokyo, Japan

[21] Appl. No.: 524,666

[22] Filed: Aug. 19, 1983

[51] Int. Cl.[3] ..... B41M 5/18

[52] U.S. Cl. ..... 346/208; 346/221; 346/209

[58] Field of Search ..... 282/27.5; 427/150–152; 428/320.8, 488, 411, 537, 913, 914

[56] References Cited

U.S. PATENT DOCUMENTS 3,924,027 12/1975 Saito et al. ..... 282/27.5

3,957,288 5/1976 Lemahiel et al. ..... 282/27.5

FOREIGN PATENT DOCUMENTS 57-156293 9/1982 Japan ..... 282/27.5

*Primary Examiner*—Bruce H. Hess

*Attorney, Agent, or Firm*—Oblon, Fisher, Spivak, McClelland & Maier

[57] ABSTRACT

A heat-sensitive recording sheet having a color-forming layer comprising a colorless or pale-colored chromogenic dyestuff and a hydroxyphthalic acid diester having a melting point of from about 60° to about 120° C.

10 Claims, No Drawings

HEAT-SENSITIVE RECORDING SHEET

The present invention relates to a heat-sensitive recording sheet. More particularly, it relates to a color-developing agent used for a heat-sensitive recording sheet.

A heat-sensitive recording sheet is usually prepared by coating on the surface of a base sheet a colorless or pale-colored chromogenic dyestuff and a color-developing agent in independent fine particle form together with a binder and other additives. When the recording sheet thus prepared is brought in contact with a heating element such as a thermal head or a heating pen in a recording apparatus, the dyestuff will react with the color-developing agent to form a black color which will be recorded on the sheet.

Heretofore, as the color-developing agent, phenol-type color-developing agents have been used. For instance, bisphenol A (melting point: 156°–158° C.) is widely used as it is stable in its quality, inexpensive and readily available. However, this bisphenol A has a drawback that its color-forming temperature is high. Whereas, a phenol-type substance having a low melting point, for instance, a monophenol such as 4-tert-butylphenol, $\alpha$-naphthol or $\beta$-naphthol, is used, the heat-sensitive recording sheet tends to have poor storage stability and gradually undergoes self-color development even at room temperature. Besides, it tends to have a strong odor i.e. a so-called phenolic odor. Therefore, such a substance is not suitable for practical applications. Further, Japanese Examined Patent Publication No. 12819/1979 discloses that p,p'-(1-methyl-n-hexylidene)-diphenol has a low melting point and is capable of providing a heat-sensitive recording sheet having good stability and color-forming property. However, this material has a difficulty that it is not readily available.

In an attempt to overcome the above-mentioned drawbacks, it has been proposed to use p-hydroxybenzoic acid esters (Japanese Unexamined Patent Publication No. 144193/1981), and its benzyl ester is practically used. However, this material has a drawback such that its sublimation property is so great that it tends to lead to an uneven color density in the recorded image.

The present inventors have conducted extensive researches to overcome the above-mentioned conventional drawbacks, and have finally found that the drawbacks can be overcome by employing hydroxyphthalic acid diesters as the color-developing agent. The present invention has been accomplished based on this discovery.

Namely, the present invention provides a heat-sensitive recording sheet having a color-forming layer comprising a colorless or pale-colored chromogenic dyestuff and a hydroxyphthalic acid diester having a melting point of from about 60° to about 120° C.

Now, the present invention will be described with reference to the preferred embodiments.

As the hydroxyphthalic acid diester to be used in the present invention, there may be mentioned diesters of 4-hydroxy-orthophthalic acid, 2-, 4- or 5-hydroxyisophthalic acid or hydroxy-terephthalic acid. For instance, the dialkyl esters, diphenyl ester and benzyl ester as listed in Table 1 may be used. Among these hydroxyphthalic acid diesters, 4-hydroxyphthalic acid diesters are preferred. Particularly preferred is 4-hydroxyphthalic acid dimethyl ester.

TABLE 1

| Hydroxyphthalic acid diesters | | |
|---|---|---|
| No. | Names of the Compounds | Melting point (°C.) |
| 1 | 2-Hydroxyisophthalic acid | |
| | dimethyl ester | 72 |
| | diethyl ester | 112 |
| | diphenyl ester | 99 |
| 2 | 4-Hydroxyisophthalic acid | |
| | dimethyl ester | 96 |
| | diethyl ester | 52 |
| 3 | 5-Hydroxyisophthalic acid diethyl ester | 103 |
| 4 | 4-Hydroxyphthalic acid | |
| | dimethyl ester | 107–108 |
| | diethyl ester | 60–62 |
| | n-propyl ester | 49–51 |
| | i-propyl ester | 103–105 |
| | benzyl ester | 87–90 |
| 5 | Hydroxyterephtalic acid dimethyl ester | 94 |

The hydroxyphthalic acid diester to be used in the present invention should have a melting point of from about 60° to about 120° C. If the melting point is too low, the storage stability becomes poor, and the contrast of the recorded image tends to be inferior. On the other hand, if the melting point is too high, a high color-forming temperature for recording will be required, and no adequate thermal response will be obtainable with a minimum heat energy, whereby such a recording sheet will not be useful for a recent high-speed recording system such as facsimile.

The hydroxyphthalic acid diester may readily be prepared by a conventional process wherein ortho-, meta- or tere-phthalic acid is sulfonated or halogenated by a usual method, the sulfonated product is subjected to alkali fusion and the halogenated product is subjected to hydrolysis in an aqueous sodium hydroxide solution, and the hydroxyphthalic acid thereby obtained is esterified in the presence of an acid catalyst.

The hydroxyphthalic acid diester of the present invention may be used alone as a color-developing agent for the heat-sensitive recording sheet. However, depending upon the particular purpose and required properties, it may be used in combination with commonly employed phenols such as bisphenol A, p,p'-(1-methyl-n-hexylidene)diphenol, p-tert-butylphenol, p-phenylphenol and a novolak-type phenol resin, or organic acids.

As the colorless or pale-colored chromogenic dyestuff to be used in the present invention, various conventional dyestuffs may be used without any particularly restriction. For instance, the following may be mentioned.

Compounds having a lactone ring (1) Fluoran-type (a) 3-Diethylamino-6-methyl-7-anilinofluoran (black)
(b) 3-(N-ethyl-p-toluidino)-6-methyl-7-anilinofluoran (black)
(c) 3-Diethylamino-6-methyl-7-(ortho- or paradimethyl anilino)fluoran (black)
(d) 3-Pyrrolidino-6-methyl-7-anilinofluoran (black)
(e) 3-Piperidino-6-methyl-7-anilinofluoran (black)
(f) 3-(N-cyclohexyl-n-methylamino)-6-methyl-7-anilinofluoran (black)
(g) 3-Diethylamino-7-(meta-trifluoromethylanilino)-fluoran (black)
(h) 3-Diethylamino-6-methyl-chlorofluoran (red)

(i) 3-Diethylamino-6-methyl-fluoran (red)
(j) 3-Cyclohexylamino-6-chlorofluoran (orange)
(k) 3-(N-cyclohexyl-N-methylamino)-6-methyl-7-anilinofluoran (black)

(2) Others

An indolylphthalide type, a lactam type, a spiropyran type, and a chromenoindole type.

Among these dyestuffs, the fluoran-type compounds are particularly preferred. Other dyestuffs have certain drawbacks such that they tend to undergo color fading or their properties are likely to be changed by light prior to their use, whereby their application is rather limited.

Among the fluoran-type compounds, compounds (a), (d) and (k) listed under the above item (1) are particularly useful for practical applications.

The above-mentioned color-developing agent and chromogenic dyestuff are pulverized into fine particles having a particle size of at most a few microns by means of a pulverizer such as a ball mill, an attriter or a sand grinder or a proper emulsifying apparatus, and depending upon the particular purpose, various additives are then added to obtain a coating composition. To this coating composition, it is usual to add a binder such as polyvinyl alcohol, hydroxyethyl cellulose, methyl cellulose, starches, a styrene-maleic anhydride copolymer, a vinyl acetate-maleic anhydride copolymer or a styrene-butadiene copolymer, and an inorganic or organic filler such as kaolin, calcined kaolin, diatomaceous earth, talc, titanium, calcium carbonate, magnesium carbonate or aluminum hydroxide. Further, a releasing agent such as a metal salt of a fatty acid, a lubricant such as wax, a ultraviolet ray absorber such as a benzophenone-type or triazole-type ultraviolet ray absorber, a water-proofing agent such as glyoxal, a dispersing agent or antifoaming agent may be incorporated. Particularly, it is preferred to incorporate a stabilizer to prevent the yellowing of the background color or to prevent the color fading of the recorded image. The coating composition thus prepared is coated on paper sheets or a variety of films, to obtain desired heat-sensitive recording sheets.

The kind and amount of the hydroxyphthalic acid diester and the amounts of various other components to be used in the present invention, are determined depending upon the required performance and recording properties, and there is no particular restriction. However, it is usual that from 2 to 10 parts by weight of the hydroxyphthalic acid diester and from 1 to 20 parts by weight of the filler are used relative to 1 part by weight of the chromogenic dyestuff, and the binder is used in an amount of from 10 to 20% by weight of the total solid content.

As the above-mentioned stabilizer, antioxidants commonly used for plastic products, rubber products or petroleum products, may usually be used for instance, there may be mentioned phenols having a melting point of at least 90° C. and a water solubility of at most 0.1 g/100 g, such as monophenols, or hydroquinones and bisphenols, as disclosed in Japanese Unexamined Patent Publication Nos. 83495/1982 and 116689/1982.

As such a phenol, there may be mentioned, for instance, 2-hydroxy-4-benzyloxybenzophenone, resorcinolmonobenzoate, 2,5-di-t-butylhydroquinone, 2,5-di-t-amylhydroquinone, 2,2'-methylene-bis(4-ethyl-6-t-butylphenol), 2,2'-methylene-bis(4-methyl-6-t-butylphenol), 4,4'-butylidene-bis(6-t-butyl-3-methylphenol), 4,4'-isopropylidene diphenol, 4,4'-cyclohexylidene diphenol, 2,2'-methylene-bis(4-methyl-6-cyclohexylphenol), 4,4'-methylene-bis(2,6-di-t-butylphenol), 2,2'-isobutylidenebis(4,6-dimethylphenol), bis(3-methyl-4-hydroxy-5-t-butylbenzyl)sulfide, 4,4'-thiobis(6-t-butyl-3-methylphenol), 4,4'-methylene-bis(2,6-di-t-butylphenol), 4,4'-thiobis-(6-t-butyl-o-cresol) or 2,6-bis(2'-hydroxy-3'-t-butyl-5-methylbenzyl)-4-methylphenol.

The stabilizer is usually used in an amount of from 0.05 to 2 parts by weight, preferably from 0.1 to 1 part by weight, relative to 1 part by weight of the 4-hydroxyphthalic acid diester.

Now, the present invention will be described in further detail with reference to Examples. In the Examples, "parts" means "parts by weight".

EXAMPLE 1

Solution A (Dispersion of dyestuff)

3-Diethylamino-6-methyl-7-anilinofluoran: 2.0 parts
10% aqueous solution of polyvinyl alcohol: 4.6 parts
Water: 2.5 parts Solution B (Dispersion of color-developing agent)

Developing agent* (see Table 2): 6.0 parts
Zinc stearate: 0.5 part
10% aqueous solution of polyvinyl alcohol: 30 parts

*: As the developing agent, hydroxyphthalic acid diesters and bisphenol A were used as shown in Table 2.

Each of the above-mentioned solutions was individually ground to a particle size of 3 μm. Then, the dispersions were mixed in the following proportions to obtain a coating composition.

Solution A (Dispersion of dyestuff): 9.1 parts
Solution B (Dispersion of color-developing agent): 36.5 parts
Kaolin clay (50% dispersion): 12 parts This coating composition was applied to one side of a base sheet of 50 g/m² in an amount of 6.0 g/m² and dried. The sheet thus obtained was treated by supercalender to bring the smoothness to be from 200 to 300 seconds. With respect to each black-color developing heat-sensitive recording sheet, the property test was conducted. The results are shown in Table 2.

TABLE 2

| | | Color-developing agent | Background color (1) Initial | Background color (1) 1 week later | Color forming sensitivity: Static image density (2) | Color forming sensitivity: Dynamic image density (3) | Sticking (4) |
|---|---|---|---|---|---|---|---|
| Example | 1-1 | 2-Hydroxyisophthalic acid diethyl ester | 0.05 | 0.05 | 1.18 | 1.15 | ◎ |
| | 1-2 | 2-Hydroxyisophthalic acid diphenyl ester | 0.05 | 0.05 | 1.18 | 1.15 | ◎ |
| | 2-1 | 4-Hydroxyisophthalic acid dimethyl ester | 0.06 | 0.06 | 1.09 | 1.13 | ◎ |
| | 3-1 | 5-Hydroxyisophthalic acid diethyl ester | 0.05 | 0.05 | 1.09 | 1.15 | ◎ |

TABLE 2-continued

| | | Color-developing agent | Background color (1) Initial | Background color (1) 1 week later | Color forming sensitivity: Static image density (2) | Color forming sensitivity: Dynamic image density (3) | Sticking (4) |
|---|---|---|---|---|---|---|---|
| | 4-1 | 4-Hydroxyphthalic acid dimethyl ester | 0.05 | 0.05 | 1.20 | 1.20 | ◎ |
| | 5-1 | Hydroxyterephthalic acid dimethyl ester | 0.06 | 0.07 | 1.08 | 1.19 | ◎ |
| Comparative Example | 6-1 | Bisphenol A | 0.08 | 0.12 | 0.28 | 0.81 | X |

Notes:
(1) Measured by Macbeth densitometer RD-104.
(2) The heat-sensitive recording sheet was pressed against a plate heated at a temperture of 105° C. under pressure of 10 g/cm$^2$ for 5 seconds, whereupon the developed color was measured by Macbeth densitometer RD-104.
(3) The image recording was conducted by means of a thermal facsimile KB-4800 manufactured by Toshiba Corporation with a pulse width of 3.0 milli-sec. and an impressed voltage of 18.0 V, and the image density was measured by Macbeth densitometer RD-104.
(4) The rush print recording was conducted by means of a thermal facsimile KB-500 manufactured by Toshiba Corporation and the sticking was determined by the following evaluation standards:
X: The noise generated during the recording is substantial, and white spots were observed in the recorded image.
: No trouble.

It is evident from Table 2 that samples 1-1 to 5-1 of Example 1 of the present invention exhibited better background brightness than the sample 6-1 of the Comparative Example in which bisphenol A was used, and the change in the background brightness was small. As compared with the Comparative Example, the image density, particularly the dynamic image density when recorded by means of the facsimile, according to the present invention was superior, and no substantial white spots were observed in the recorded images.

EXAMPLE 2

Solution A (Dispersion of dyestuff)

3-Diethylamino-6-methyl-7-anilinofluoran: 2.0 parts
10% aqueous solution of polyvinylalcohol: 4.6 parts
Water: 2.5 parts

Solution B (Dispersion of color-developing agent)

Dimethyl 4-hydroxyphthalate: 5.0 parts
Lead stearate: 0.5 part
10% aqueous solution of polyvinylalcohol: 22 parts

Solution C (Dispersion of stabilizer)

2,2'-Methylene-bis(4-methyl-6-t-butylphenol): 1 part
10% aqueous solution of polyvinylalcohol: 4.0 parts Each of Solutions A, B and C was ground to a particle size of 3 μm in a ball mill. Then, 9.1 parts of Solution A, 57.5 parts of Solution B, 5.0 parts of Solution C and 12 parts of kaolin clay (50% dispersion) were mixed to obtain a coating composition.

With use of this coating composition, the property tests were conducted in the same manner as in Example 1, whereby the color-forming sensitivity was found to be 1.20, and no substantial change in the image density was observed when left to stand still at room temperature for three weeks. However, in the case where Solution C was not incorporated, yellowing was observed in the background color.

Further, a similar test was conducted with respect to 4-hydroxybenzoic acid esters, whereby it was found that the color-forming sensitivity obtained by the Example of the present invention was higher by about 10% than that obtained with use of the 4-hydroxybenzoic acid esters.

We claim:

1. A heat-sensitive recording sheet having a color-forming layer comprising a colorless or pale-colored chromogenic dyestuff and a hydroxyphthalic acid diester having a melting point of from about 60° to about 120° C.

2. The heat-sensitive recording sheet according to claim 1, wherein the dyestuff is a fluoran-type dyestuff.

3. The heat-sensitive recording sheet according to claim 2, wherein the fluoran-type dyestuff is 3-(N-cyclohexyl-N-methylamino)-6-methyl-7-anilinofluoran, 3-pyrrolidino-6-methyl-7-anilinofluoran or 3-diethylamino-6-methyl-7-anilinofluoran.

4. The heat-sensitive recording sheet according to claim 1, wherein the hydroxyphthalic acid diester is a dialkyl ester of hydroxyorthophthalic acid, hydroxyisophthalic acid or hydroxyterephthalic acid.

5. The heat-sensitive recording sheet according to claim 4, wherein the hydroxyphthalic acid diester is a 4-hydroxyphthalic acid diester.

6. The heat-sensitive recording sheet according to claim 5, wherein the 4-hydroxyphthalic acid diester is a dimethyl ester.

7. The heat-sensitive recording sheet according to claim 1, wherein the color-forming layer contains, as a stabilizer, a phenol having a melting point of at least 90° C. and a water solubility of at most 0.1 g/100 g.

8. The heat-sensitive recording sheet according to claim 7, wherein the phenol is a hydroquinone or a bisphenol.

9. The heat-sensitive recording sheet according to claim 8, wherein the hydroquinone is 2,5-di-t-butylhydroquinone or 2,5-di-t-amylhydroquinone.

10. The heat-sensitive recording sheet according to claim 8, wherein the bisphenol is 2,2'-methylene-bis(4-methyl-6-t-butylphenol), 2,2'-methylene-bis(4-ethyl-6-t-butylphenol), 1,1'-bis-(4-hydroxyphenyl)cyclohexane, 2,6-bis-(2'-hydroxy-3'-t-butyl-5-methylbenzyl)-4-methylphenol or 2,2'-isobutylidene-bis(4,6-di-methylphenol).

* * * * *